US006139421A

United States Patent [19]

Tong et al.

[11] Patent Number: 6,139,421

[45] Date of Patent: Oct. 31, 2000

[54] PAINT SPRAY BOOTH-DIFFERENTIAL DOWNDRAFT CONTROL

[75] Inventors: Ernest Henry Tong, Canton; Yu-Ning Liu, Ann Arbor, both of Mich.

[73] Assignee: Ford Global Technologies, Inc., Dearborn, Mich.

[21] Appl. No.: 09/192,482

[22] Filed: Nov. 16, 1998

[51] Int. Cl.[7] ..... B05B 15/12

[52] U.S. Cl. ..... 454/52; 118/326

[58] Field of Search ..... 454/52, 51; 118/326, 118/DIG. 7; 55/DIG. 46

[56] References Cited

U.S. PATENT DOCUMENTS

| | | | |
|---|---|---|---|
| 4,537,120 | 8/1985 | Josefsson . | |
| 4,687,686 | 8/1987 | Stofleth et al. . | |
| 5,034,042 | 7/1991 | Allen, Jr. | 55/385.2 |
| 5,153,034 | 10/1992 | Telchuk et al. . | |
| 5,173,118 | 12/1992 | Josefsson . | |
| 5,480,349 | 1/1996 | Kolta | 454/52 |
| 5,512,017 | 4/1996 | Gore et al. . | |
| 5,855,509 | 1/1999 | White et al. | 454/52 |

FOREIGN PATENT DOCUMENTS

| | | |
|---|---|---|
| 38 02 597 | 8/1989 | Germany . |
| 0 422 254 A1 | 4/1991 | Germany . |

*Primary Examiner*—Harold Joyce
*Assistant Examiner*—Derek S. Boles
*Attorney, Agent, or Firm*—Joseph W. Malleck

[57] ABSTRACT

A paint spray cell and air plenum assembly, comprising (a) a paint spray cell having a perforate air inlet wall occupying at least a substantial portion of one side of the cell and having at least one electrostatic paint sprayer to direct charged spray particles along a desired path to a receptive target, (b) a plenum having an undivided air supply and an outlet joined to the cell inlet wall to admit the air uniformly therethrough, and (c) variable density filter media at the plenum outlet to create differential velocity flows through said inlet wall that affect paint particles differently in different locations to both optimize paint transfer efficiency to the target and reduce paint particle adherence to objects other than the target. A method of increasing paint transfer efficiency when spraying electrocharged paint particles onto an automobile panel or body positioned within a cell and through which air flow is moved to exhaust stray paint emissions, comprising (a) interposing different density filter media at different locations in the air flow through which the air must pass to effect at least high and low air velocity drafts, (b) placing (i) paint spraying equipment, and (ii) surfaces to be painted by sprayed particles generally perpendicular to the air flow, in the high velocity air flow, and (c) placing surfaces to be painted by sprayed particles, generally aligned with the air flow, in the high velocity flow.

15 Claims, 3 Drawing Sheets

PAINT SPRAY BOOTH-DIFFERENTIAL DOWNDRAFT CONTROL

TECHNICAL FIELD

This invention relates to the technology of regulating air flow in a paint booth, and more particularly to affecting different downdraft flow rates in different parts of the paint booth.

DISCUSSION OF THE PRIOR ART

State-of-the-art automated painting booths in the automotive industry typically use paint spray bells that electrostatically create a cloud of charged fluid paint droplets that are gently propelled toward the target (such as an automobile body surface) by charge attraction. These bells are typically placed at varying locations spaced from the target surface to apply paint of a very high quality for surface and texture. Each cell of the paint booth has forced uniform downdrafts therethrough which are made uniform by a constant density layer of filter medium across the entire cell ceiling, or downdraft inlet, of the booth. Such downdraft air flow is needed to move and capture volatile organic vapors for meeting Environmental Protection Agency regulations and for directing lost sprayed paint particles to a disposal unit.

Unfortunately, such forced downdrafts need to have a high velocity in certain regions and a relatively low velocity in other regions. For generally vertically oriented target surfaces, such as the sides of an automobile body, the downdraft air flow ideally will intersect with the direction of migration of paint particles from the bell with a relatively nonturbulent low velocity to encourage a higher percentage of droplets reaching the target surface. On the other hand, high velocity downdrafts which are highly turbulent are needed to more effectively scrub equipment and booth walls in certain regions to avoid excessive spray paint buildup, or to facilitate a greater percentage of paint particles, from an overhead bell, to strike a target surface that is generally horizontally oriented.

The prior art has attempted to attain differential high and low velocities within a paint booth cell by dividing the supply air (from a supply plenum above the spray booth) into mechanically separated flows of different areas and thus of different velocities such as shown in U.S. Pat. No. 5,512,017. The mechanically separated flows feed into different sized subplenums with the different sizing of the subplenums achieving the different flow velocities.

Instead of fixed subplenums with flow partitions, the prior art has also attempted to extend mechanical partitions down into the paint spraying chamber or cell accompanied by adjustable air flow reducers (perforated plates) in the perimeter portions of the ceiling to admit lower or higher velocity flow one side of the partitions (see U.S. Pat. No. 5,173,118 and German Patent 38 02 597).

Such approaches by the prior art have proven to: (a) require too high an initial capital investment cost, (b) lack flexibility in readily achieving uniform flow velocities at different x-y locations of the ceiling plenum, or (c) lack the capability to provide ease of attaining a variety of different flow gradients.

SUMMARY OF THE INVENTION

It is a primary object of this invention to provide a more convenient, lower cost, more flexible manner of producing different air flows with varying local flow velocities within the various cells of a paint spray booth.

The apparatus aspect of this invention, that meets such object, comprises in a first aspect, a paint spray cell and air plenum assembly, comprising (a) a paint spray cell having a perforate air inlet wall occupying at least a substantial portion of one side of the cell and having at least one electrostatic paint sprayer to direct charged spray particles along a desired path to a receptive target, (b) a plenum having an undivided air supply and an outlet joined to the cell inlet wall to admit the air uniformly therethrough, and (c) variable density filter media at the plenum outlet to create differential velocity flows through said inlet wall that affect paint particles differently in different locations to both optimize paint transfer efficiency to said target and reduce paint particle adherence to objects other than the target. The invention also comprises, in a second aspect, a method of increasing paint transfer efficiency when spraying electrocharged paint particles onto an automobile panel or body positioned within a cell and through which air flow is moved to exhaust spray paint emissions, comprising (a) interposing different density filter media at different locations in the air flow through which the air must pass to effect at least high and low air velocity drafts, (b) placing (i) paint spraying equipment and (ii) surfaces to be painted by sprayed particles generally aligned with the air flow, in the low velocity air flow, and (c) placing surfaces to be painted by sprayed particles, aligned generally perpendicular to the air flow, in the high velocity flow.

Preferably, the filter media has a density that provides a velocity in the range of 70–100 fpm for use in creating high velocity downdrafts, and a density that provides a velocity in the range of 40–70- fpm for creating low velocity downdrafts. The media density may be adjusted or replaced in response to measured paint film buildup or monitored density of paint particles in the air flow as measured by a laser device.

DETAILED DESCRIPTION AND BEST MODE

Figure 1:
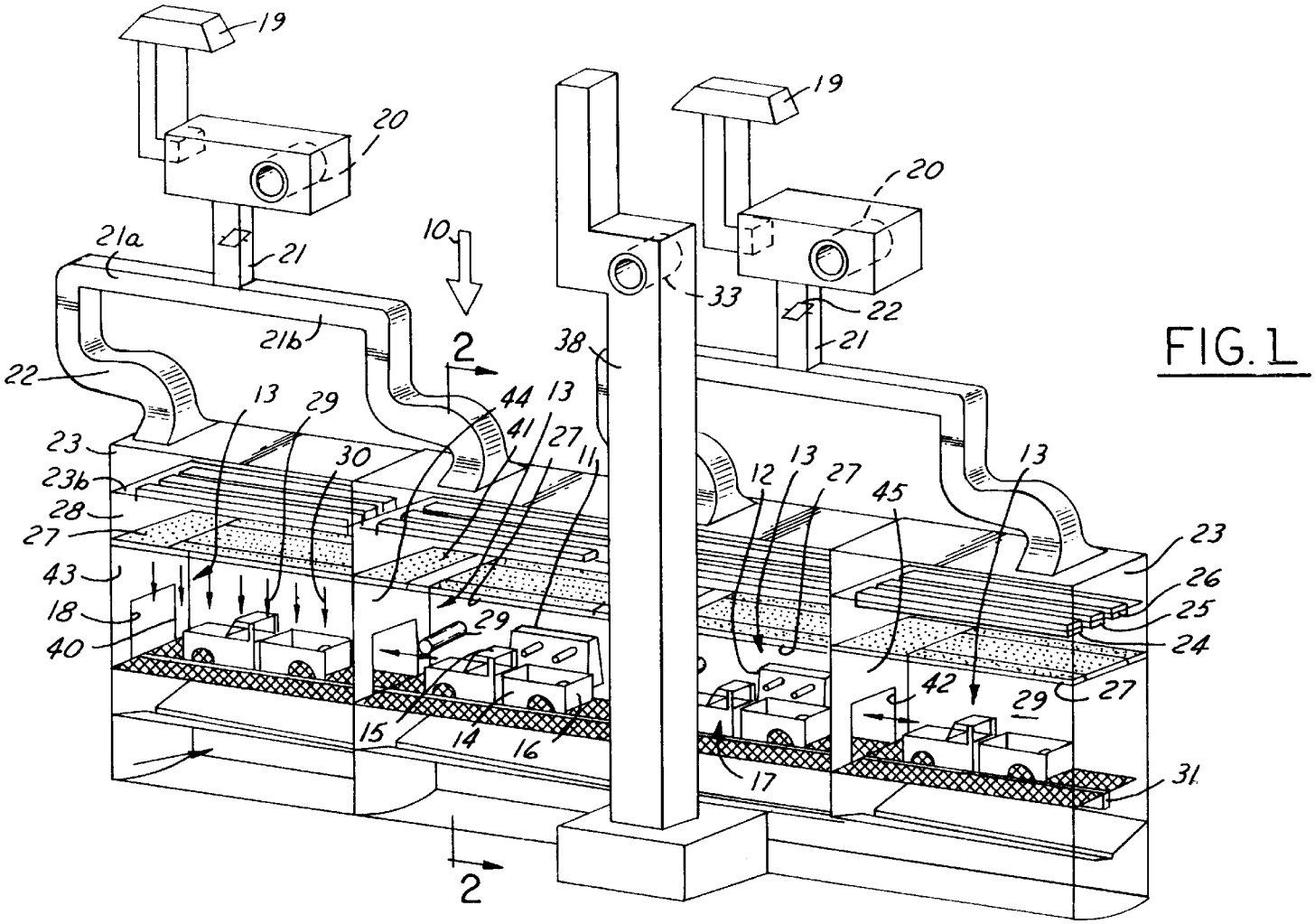
FIG. 1 is a perspective view of a typical paint booth assembly showing the different cells for carrying out different steps in the painting process of an automotive body, such figure illustrating the use of differential filter media for achieving different downdrafts at different locations within a cell.

As shown in FIG. 1, an automotive paint spray booth assembly 10 employs electrostatic spray paint application modules 11 and 12 in some of the cells 13 of the assembly to carry out painting of side panels 14, top panels 15, and end panels 16 of vehicle bodies 17. Such painting is carried out with spray bells charged with 90,000 volts or more, with the spray bell being located relatively close to the target surface. Each interior working space 29 of each cell 13 is open and connected to an adjacent cell by way of large wall openings 18 through which the vehicle bodies can pass as they are continuously conveyed. A large volume of air passes through each cell 13 to carry away volatile emissions from the interconnected cells 13, the emissions containing varying amounts of suspended paint particles. Such emissions must be removed as mandated by federal regulations. To facilitate emission removal, a large quantity of air is not only pushed into assembly 10 through inlets 19 by powerful electrically powered supply fans 20, but withdrawn or sucked from such assembly by large powerful exhaust fans 33. The air is forced by such fans first through the ducts 21 (divided into duct work 21*a* and 21*b*), which may contain a dampers 22 therein to affect control of the main air flow. As shown also in FIG. 2, the air flow is carried to an upper plenum 23 for each cell 13 where the air flow meets a diffuser plate 23*a* causing the air flow to be spread across the entire area of the upper plenum. A group of elongated bag-type filters (here, 24, 25, 26) hang from the bottom wall 23*b* of each cell plenum 23. After exiting from the bag-type filters, the air flows into and across a second or lower plenum 28 to meet a wall 27 that defines the top or ceiling of each chamber 29 for each cell. Heretofore, wall 27 has usually been constructed of steel mesh over which a synthetic low level air filtering media is laid in a uniform single density, serving to distribute downward air flow generally uniformly across the entire ceiling of chamber 29.

Air passes through such media of the cell ceiling wall 27, creating a downdraft flow 30 (see downward arrows in FIG. 1) that wrap around the vehicle body 17 as well as around equipment, such as the spray modules 11. The air flow is then sucked out through an elongated venturi slot 31A provided in a panel 31 beneath the mesh floor 32 of each cell 13. The panel 31 and venturi slot 31A are part of an air cleaning system 34 that consists additionally of means to provide a curtain of water across panel 31 that collects paint particles as they fall or are pushed by the air flow thereinto. The mixture of water and air effluent is then directed into a labryrinth 36 residing in a bottom plenum 35 further defined by walls 39; the demisted air is then funneled through a mist eliminator 37 and sent up through an exhaust stack 38 to atmosphere as sucked by the exhaust fan 33.

Although paint spraying may not take place in each chamber or cell 13, paint emissions do migrate to all of the chambers as a cross-flow provided either by damper controlled ports between cells or as a result of large openings 40, 41, 42, etc., in the separating upright walls 43, 44, 45 of the booth permitting movement of vehicle bodies between cells by a transfer line 46. Accordingly, each chamber 29 must be cleansed of paint emissions and thus large air flows are sent through each cell.

It is desirable to reduce air volume passing through the booth, not only to reduce energy consumption but also to improve paint transfer efficiency, thereby lowering the percentage of paint that is wasted through the emission cleaning system. Several factors complicate attaining this goal. First, a reduction in the downdraft flow velocity may allow charged particles of the paint to migrate and build up on processing equipment surfaces which is difficult to remove. Secondly, each cell has slightly different flow dynamics because of the cell's position and interconnectiveness in the total booth flow system. Thus, a solution to the need for varying downdraft velocities, while providing some degree of flexibility to meet different vehicle configurations, has been discovered to lie in the use of patterned filter media of different local densities. A variety of different downdraft profiles can be produced by placing different media densities at different locations or patterns in the ceiling of each cell chamber 29. The exact pattern or variation in the media density will depend upon the downdraft requirements for a particular paint booth cell.

Computer simulation can be used to optimize the filter media layout and the necessary density location before installation in a paint booth for a specific vehicle configuration. If the vehicle configuration or panel configuration, being painted, changes, the existing media or new media can be easily relocated by relaying the filter media in the desired densities to promote new optimum downdrafts as detailed by the computer simulation or even by manual mathematical calculations.

Figure 2:
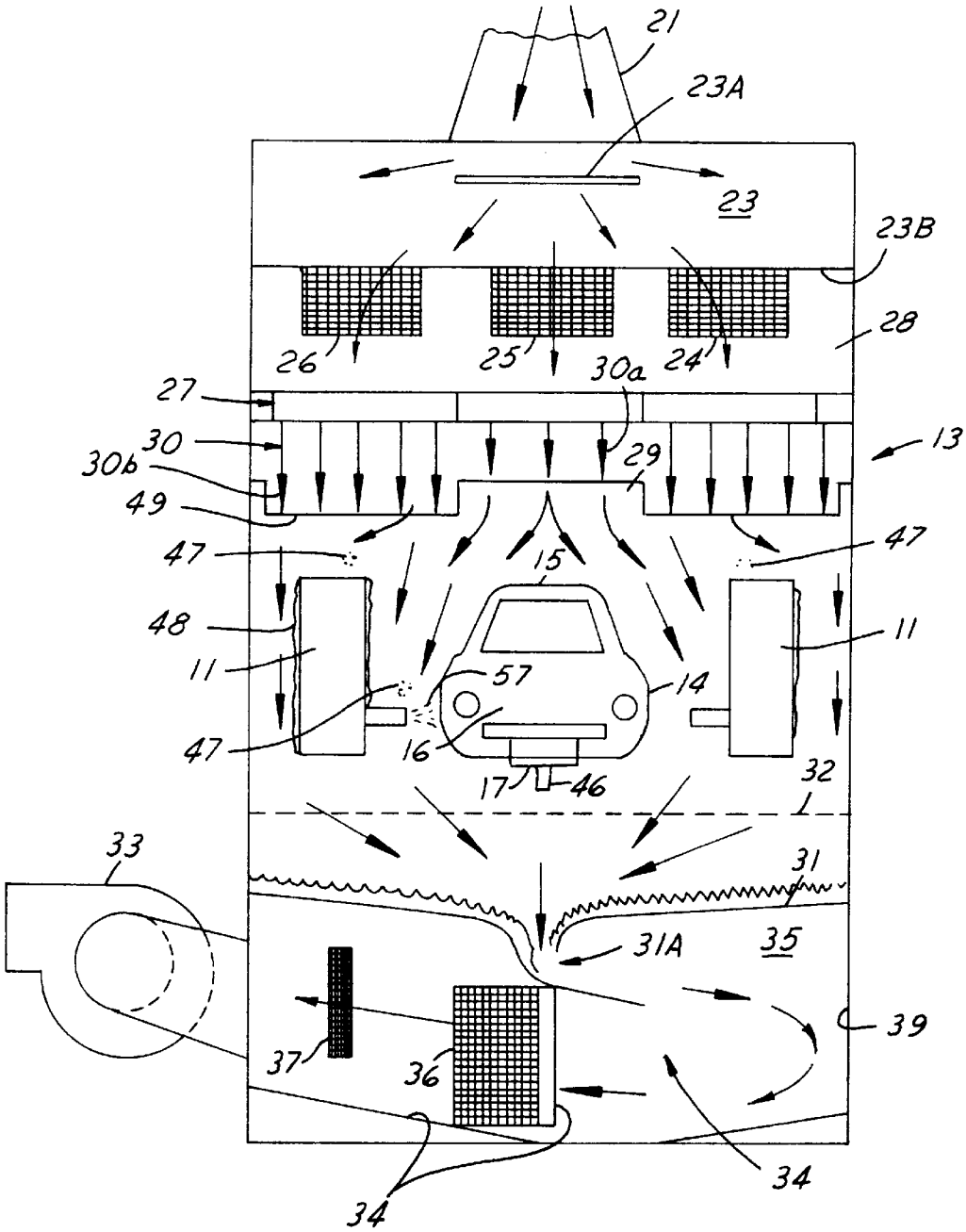
FIG. 2 is an enlarged cross-sectional view of a paint booth cell taken generally along line 2—2 of FIG. 1.
Figure 3:
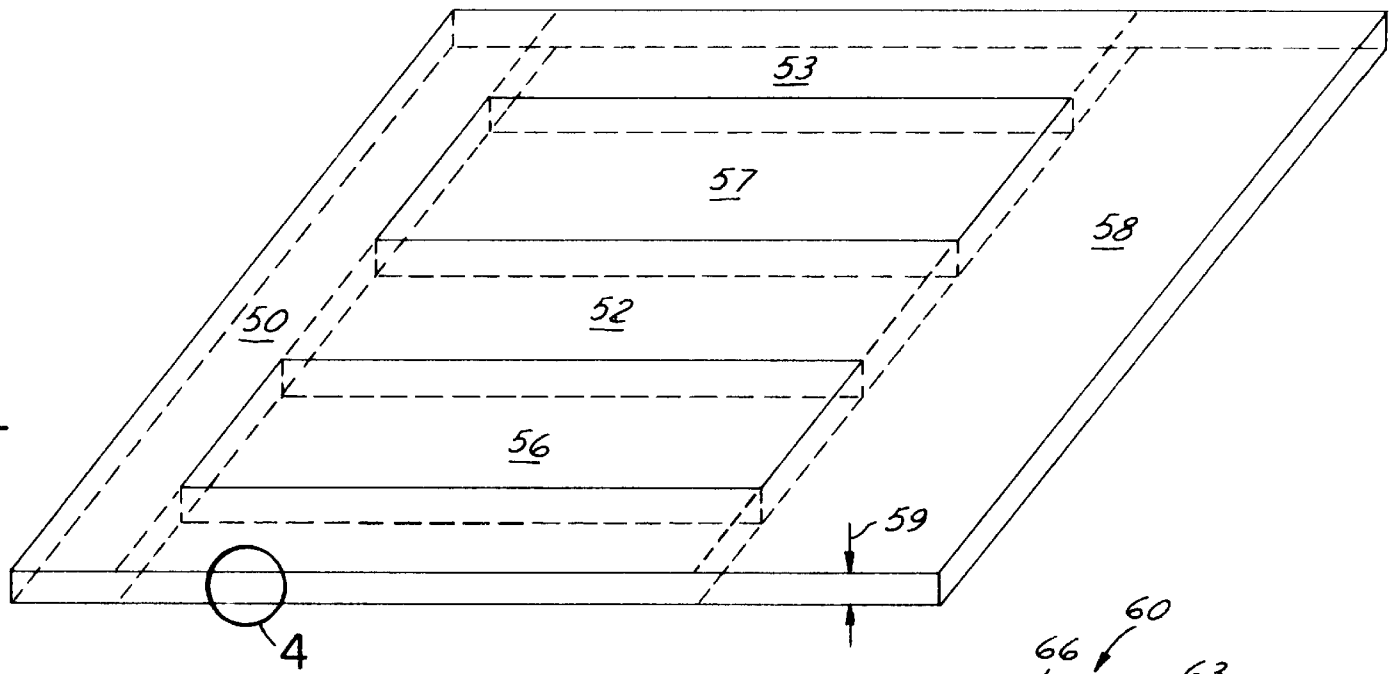
FIG. 3 is an enlarged cross-sectional plan view of the paint booth cell taken along line 3—3 of FIG. 1.

An example of a very elementary pattern arrangement is shown in FIGS. 2 and 3, for use with a paint bell zone optimized for high paint transfer efficiency for a certain vehicle configuration and with minimum paint buildup on the paint booth equipment or cell walls. Here, the filter media layout is patterned into high and low density (density being a function of filter formulation) with the media being uniform in height 59 (usually about 1") to promote uniform flow. Each high density media blanket 50, 51, 52 and 53 is a labyrinth of polyester fibers 54, which have been thermally bonded together by a polyacrylic tackefier to present a certain density; the blanket may have a thin lower section or scrim 55 which also is comprised of polyester but coated with a PVC paste for flame retardency. The scrim has a slightly denser mat to act as a support. The overall blankets (50 through 53) have a fiber density about 38–43 kg/m$^3$. The low density media blankets 56, 57, 58 are of the same construction but have an overall density about 27–34 kg/m$^3$. Each type of filter media blanket may have a different color to visually code the media as to its density or location, allowing for the visual verification of its pattern location from within the cell.

The high density filter media blankets (50, 51, 52, 53) are used to reduce the flow velocity of the downdraft pattern 30*a* that will intersect with the paint spray particles 57 attempting to move generally horizontally and attract to upright vehicle surfaces, including front and rear upright end surfaces 16 which may arrive sequentially as the vehicle is carried on a conveyor 46 to the same location under a single high density media blanket (such as blanket 50). A greater amount of paint will be transferred if the air velocity is controlled so that it does not unnecessarily intersect at right angles and sweep the charged paint particles 57 into the emission cleaning system 39.

Low density media blankets (56, 57) are arranged over the side cabinets or modules 11 containing the paint spray equipment to intersect floating paint particles 47 migrating to the walls of the equipment; the low density blankets permit a high velocity downdraft 30*b* which scrubs the equipment sides. Low density blankets (58) may also be located to allow a high velocity downdraft 30*b* to assist movement of paint particles to hit generally horizontal body surfaces such as roof, trunk lids, engine compartment closures. The low density blankets (58) may also be placed over any ceiling location adjacent and aligned to the large openings between cells to permit ingress and egress of the vehicles; this promotes a high velocity flow that acts as a air curtain to block migration of paint particles into adjacent cells. Thus, as demonstrated in FIGS. 2 and 3, low density blankets 56, 57 extend longitudinally over the cabinets of the spray equipment and blanket 58 extends over the end of the cell adjacent to the end wall which contains the large openings and promotes a high velocity air curtain thereal-ong. Blanket 52 promotes low velocity air flow over spray bells painting generally vertical surfaces, blankets 51 and 53 promote low velocity flow adjacent the cell sidewalls so as not to interrupt the high velocity flow over the spray equipment. Blanket 50 extends transversely across the area where horizontally disposed surfaces are spray painted using an overhead spray bell promoting descending particles, generally parallel to the direction of the downdraft.

The high velocity downdraft 30*b* emanating from the low density filter media blankets will scrub the walls and adjacent areas of the paint cabinets to flush the paint particles into the water washed floor panel 31. The low velocity downdrafts 30*a* emanating from the high density media blankets will permit a greater percentage of electrically charged paint particles to move to the side panels while gently carrying stray paint particles having little chance of reaching the target surface to the water washed floor panel 31.

Figure 5:
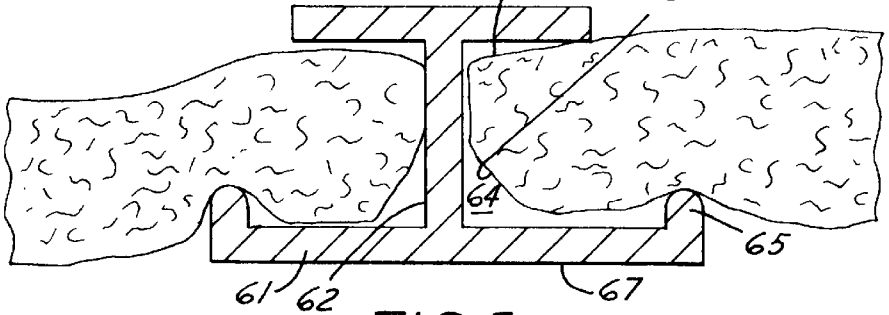
FIG. 5 is an enlarged cross-sectional view taken substantially along line 5—5 of FIG. 3, illustrating how the edges of the filter media blankets can be fastened together by a coupling strip that prevents air leakage.
Figure 4:
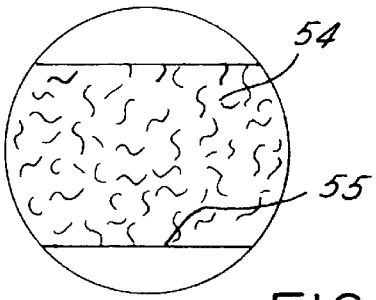
FIG. 4 is a highly enlarged view of a portion of the filter media indicating the structure of fibers contained therein.

The filter media blankets may be seamlessly connected to each other by the use of fastening strips 60 having an elongated channel 61 with a t-shaped upright rib 62, as shown in FIG. 5. When a longitudinal edge 63 of a blanket is stuffed into the channel receptacle 64 at one side and over a first lip 65, allowing the t-shaped rib 62 to overhang the top side 66 of the blanket, the base 67 of the strip completes an air sealing effect.

Thus, variable density ceiling media can be used to locally control the downdrafts in a paint spray booth. This is much less costly than mechanically dividing the plenum with physical partitions. Better downdraft uniformity is achieved because air mixing will occur in the entire lower plenum 28 without partitions. Velocity ratios within the booth can be well defined and stable since they are determined by the fixed media density or formulation, not by operator air flow control settings or movable dampers.

Laying stacks of conventional filter media, one upon the other, will not achieve a significant adjustment in flow velocity because an increased height of the filter without modifying the media formulation will not affect overall media density. Such stacking will not be useful in creating the well defined high and low velocity differentials that result from this invention.

While particular embodiments of the invention have been illustrated and described, it will be obvious to those skilled in the art that various changes and modifications may be made without departing from the invention, and it is intended to cover in the appended claims all such modifications and equivalents as fall within the true spirit and scope of this invention.

What is claimed is:

1. A paint spray cell and air plenum assembly, comprising:

(a) a paint spray cell having a perforate air inlet wall occupying at least a substantial portion of one side of the cell and having at least one electrostatic paint sprayer to direct charged spray particles along a desired path to a receptive target;

(b) a plenum having an undivided air supply and an outlet joined to said cell inlet wall to admit said air uniformly therethrough; and (c) variable density filter media at said plenum outlet to create differential velocity flows through said inlet wall that affect paint particles differently in different locations to both optimize paint transfer efficiency to said target and reduce paint particle adherence to objects other than the target.

2. The assembly as in claim 1, in which said variable density filter media has two or more large zones within which the media density is uniformly high, thereby creating a flow pressure drop therethrough which has a reduced effect for interfering with paint spray particles migrating in a generally horizontal direction.

3. The assembly as in claim 1, in which the densities of the variable density filter media are arranged in a pattern to effect a low velocity downdraft from air that passes through the high density filter media, and a high velocity downdraft that passes through the low density filter media.

4. The assembly as in claim 3, in which said low density media is effective to promote a downdraft flow velocity in the range of 70–100 feet per minute, while the high density filter media has a density to effect a downdraft velocity in the range of 40–70 feet per minute.

5. The assembly as in claim 1, in which the inlet wall is constructed as the ceiling of the cell and the air plenum is not only generally coextensive with such ceiling but has a height effective to promote mixing of the undivided air supply throughout the entire plenum volume.

6. The assembly as in claim 1, in which said filter media has at least two distinct density regions, a low density filter media region providing a velocity in the range of 70–100 fpm, and a high density filter media region providing a velocity in the range of 40–70 fpm.

7. The assembly as in claim 6, in which said low density media has an average fiber density in the range of 27–34 $kg/m^3$ and said high density media has an average fiber density in the range of 38–43 $kg/m^3$.

8. The assembly as in claim 1, in which said filter media is comprised of polyester fibers formed as blankets having a generally uniform height in the range of 0.5–2 inches.

9. The assembly as in claim 8, in which said blankets are coupled together by an elongated strip having a t-shaped rib extending upwardly from a shallow base cup, the strip providing a leakless seam between the independent blankets laid side-by-side.

10. A method of increasing paint transfer efficiency when spraying electrocharged paint particles onto an automobile panel or body positioned within a cell and through which air flow is moved to exhaust stray paint emissions, comprising:

(a) interposing different density filter media at different locations in the air flow through which said air must pass to effect at least high and low air velocity drafts;

(b) placing (i) paint spraying equipment, and (ii) surfaces to be painted by sprayed particles generally aligned with the air flow in the high velocity air flow; and (c) placing surfaces to be painted by sprayed particles, aligned generally perpendicular to the air flow, in the high velocity flow.

11. The method as in claim 10, in which the differential media densities are adjusted by measuring the paint film buildup on the target surfaces in a given period of time and changing to the densities giving the greatest paint buildup while reducing paint buildup on the equipment.

12. The method as in claim 10, in which the differential media densities are adjusted by monitoring paint particle densities suspended during spraying by use of a laser device and measuring the quantity of charged paint particles that arrive at the surfaces to be sprayed, and then adjusting the media to obtain the greatest paint buildup on surfaces to be painted while reducing the paint buildup on surfaces that are not to be painted.

13. The method as in claim 10, in which the paint content in said exhaust emissions is reduced by at least 10% in volume.

14. The method as in claim 10, in which the high density filter media provides a velocity in the range of 40–70 fpm and promotes a pressure drop for air flow therethrough of about 0.25–0.3 inches of $H_2O$.

15. The method as in claim 10, in which a first media blanket is provided to have a density in the range of 38–43 $kg/m^3$ and a second media blanket is provided to have a density in the range of 27–34 $kg/m^3$, said blankets being butted together with a strip interposed therebetween, said strip having upstanding ribs to grip the blanket edges.

* * * * *